United States Patent [19]

Santo

[11] Patent Number: 4,740,397

[45] Date of Patent: Apr. 26, 1988

[54] COMPOSITE STRUCTURAL FRAME COMPONENT

[76] Inventor: Phillip J. Santo, 12 Mountain Rd., Rochester, N.Y. 14625

[21] Appl. No.: 712,630

[22] Filed: Mar. 18, 1985

[51] Int. Cl.[4] ..... B32B 3/30; B32B 1/06

[52] U.S. Cl. ..... 428/12; 156/227; 156/268; 428/151; 428/167; 428/187; 428/542.2

[58] Field of Search ..... 428/14, 12, 26, 167, 428/187, 151, 542.2, 542.8; 156/227, 268; 40/152, 155

[56] References Cited

U.S. PATENT DOCUMENTS

| | | | |
|---|---|---|---|
| 3,117,902 | 1/1964 | Holzheimer | 428/167 |
| 3,129,472 | 4/1964 | Hensel | 40/152 |
| 3,552,050 | 1/1971 | Marateck | 40/155 |
| 3,802,105 | 4/1974 | Bendix | 40/152 |
| 3,886,677 | 6/1975 | Behring et al. | 428/151 |
| 3,969,868 | 7/1976 | Bainter et al. | 428/167 |

*Primary Examiner*—Paul J. Thibodeau

*Attorney, Agent, or Firm*—Lawrence P. Kessler

[57] ABSTRACT

A composite structural frame component which has a high quality appearance and substantial structural rigidity. The component comprises an elongated substantially flat member having a plurality of V-shaped grooves extending through the thickness of such member and tapered marginal edges, such grooves and tapered edges being mutually parallel and parallel to the longitudinal axis of such member. A flexible member, for example having a thickness substantially less than the thickness of the flat member, is secured to the surface of the flat member at which the apexes of the grooves are directed. The flexible member has a surface facing away from the flat member which is of a high quality appearance. Therefore, when the flat member is folded along the grooves to form an elongated structure of rectangular cross-section with a hollow interior, such structure is encased by flexible member. The resulting composite structure thus has a high quality appearance with substantial structural rigidity.

9 Claims, 2 Drawing Sheets

COMPOSITE STRUCTURAL FRAME COMPONENT

BACKGROUND OF THE INVENTION

This invention relates generally to structural frame components, and more particularly to a structural frame component which is a composite of a member having a hollow rectangular cross-section encased in a decorative member.

In the manufacture of furniture, for example, frame components serve both structural and decorative purposes. Typically frame components have been of solid cross-sectional construction; that is, the components are constructed of solid pieces of wood or wood product commonly referred to as chip or flake board. Since most woods are easily damaged, for the solid wood to have a suitable decorative appearance, the wood must be carefully finished, and such finish constantly cared for to protect the wood. Moreover, the environmental conditions in which solid wood is kept must be critically controlled. This is due to the propensity of solid wood to warp. If the wood warps, it can be rendered useless as a component in frame construction because of both its altered dimensions making it difficult to be used as a structural component and the upappealing overall appearance of a frame using such components.

When using wood product, or certain grades or imperfect pieces of solid wood, the structural member is covered with a suitable decorative veneer. While typical veneers protect the underlying wood and provide a decorative appearance, such appearance has heretofore not been of a level to match that desired of finished wood as found in high quality products. The lesser quality appearance of veneers is due primarily to their lack of thickness for detail definition, and their edge finishing. As a result veneer covered components have only been used in products intended for that portion of the market where high quality appearance is not of primary concern.

SUMMARY OF THE INVENTION

This invention is directed to a composite structural frame component which has a high quality appearance and substantial structural integrity. The component comprises an elongated substantially flat member having a plurality of V-shaped grooves extending through the thickness of such member and tapered marginal edges such grooves and tapered edges being mutually parallel and parallel to the longitudinal axis of such member. A flexible member, for example having a thickness substantially less than the thickness of the flat member, is secured to the surface of the flat member at which the apexes of the grooves are directed. The flexible member has a surface facing away from the flat member which is of a high quality appearance. Therefore, when the flat member is folded along the grooves to form an elongated structure of rectangular cross-section with a hollow interior, such structure is encased by flexible member. The resulting composite structure thus has a high quality appearance with substantial structural integrity.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENT

Figure 1:
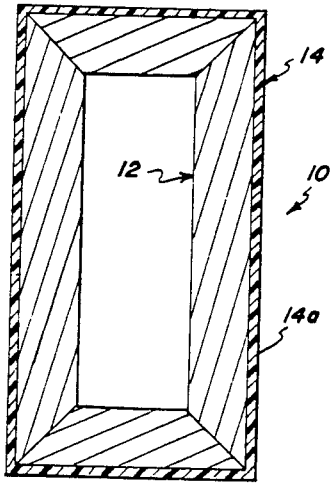
FIG. 1 is a end elevational view, in cross-section, of the composite structural frame component according to this invention.

Referring now to the accompanying drawings, the assembled composite structural frame component according to this invention is designated generally by the numeral 10 in FIG. 1. The component 10 comprises a member 12 encased in a member 14. The rectangular cross-section of the assembled composite structural frame component 10 yields a component of considerable structural rigidity. Therefore, when a plurality of components are interconnected to form a structural frame, such frame has the required strength to serve for example in furniture applications.

The member 12 is an elongated relative thick piece of material such as wood or chip board for example. The member 14, which is substantially thinner, is a flexible veneer material such as vinyl for example. The thickness of the member 14 is sufficient so that the external surface 14*a* of the member 14 has a detailed finish to resemble high quality wood. Thus when a frame is formed from components 10, such frame has a decorative appearance resembling a high quality wood product. Of course, the flexible member 14 could also be a high quality wood, in which case a detailed decorative finish would not be required.

Figure 2:
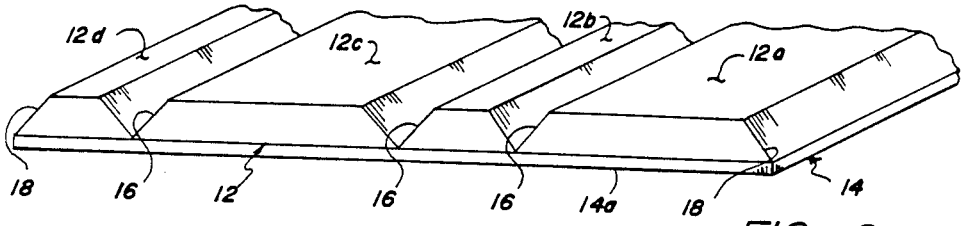
FIG. 2 is a view, in perspective on a reduced scale, of the members making up the composite structural frame component, prior to folding.

To assemble the composite structural frame component 10, the flexible veneer member 14 is secured, such as by gluing for example, to an elongated flat piece of material from which member 12 is formed with the decorative surface 14*a* facing away from the flat piece. A plurality of parallel V-shaped grooves 16 are cut in the flat piece through its thickness, the apexes of the grooves terminating at the veneer member 14 (see FIG. 2). The included angle between the walls of a groove is approximately 90°. The marginal edges 18 of the flat piece are similarly cut to have a taper to the flexible veneer member 14 at an angle of approximately 45° from vertical. The grooves 16 and tapered edges 18 are mutually parallel and parallel to the longitudinal axis of the member 12 (see FIG. 2). The spacing between the grooves 16 and the marginal edges 18 divide the flat piece into elongated segments 12*a*, 12*b*, 12*c* and 12*d*. The transverse dimensions of segments 12*a* and 12*c* are equal and substantially greater than the transverse dimensions of the segments 12*b* and 12*d*, which are also equal. As such, when the segments are folded along the grooves, they form the elongated structure of rectangular cross-section with a hollow inferior as shown in FIG. 1 encased in the flexible veneer member 14 with the entire peripheral surface having a decorative appearance, and with only one edge of the flexible member requiring finishing. Adjacent segments are secured together such as, for example, by tacking after folding or applying glue into the grooves 16 and marginal edges 18 prior to folding. The resultant assembled component 10 thus has the required rigidity to be used in a structural frame.

Figure 3:
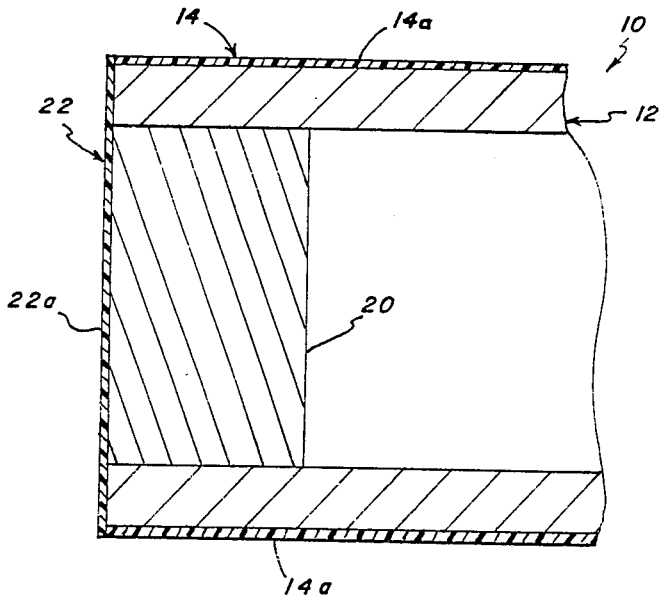
FIG. 3 is a side elevational view, in cross-section, showing the construction of a finished end of the composite structural frame component according to this invention.
Figure 4:
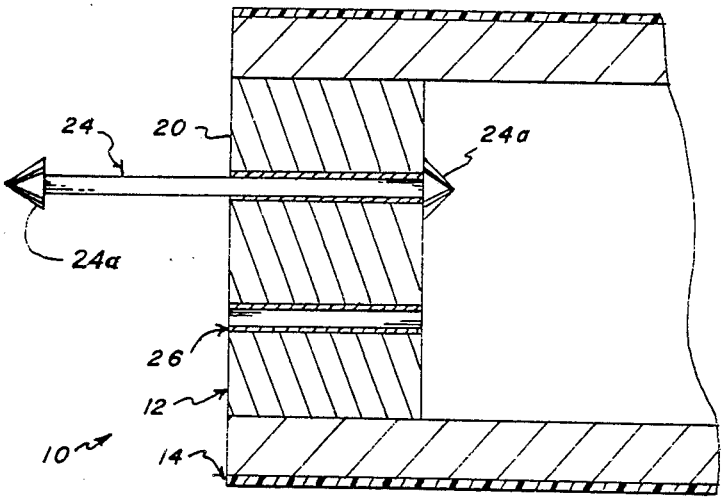
FIG. 4 is a side elevational view, in cross-section, showing the construction of an end of the composite structural frame component having an interconnective member associated therewith.

The ends of the composite structural frame component 10 are finished in a manner depending upon the requirements of the frame into which components are to be used. For example, if the ends of a component are exposed, such ends are finished to give a decorative appearance matching that of the peripheral surfaces of such component. As shown in FIG. 3 for example, an insert 20, preferably of the same material as the member 12 is secured by suitable means within the hollow of the ends (one shown) of the component 10. A veneer member 22, having a surface 22*a* matching the surface 14*a* of the veneer member 14 is secured over the ends to give the desired decorative appearance On the other hand, if the ends of a component are to abut another component and be joined thereto, such ends include suitable interconnective structures. As shown in FIG. 4 for example, the insert 20 in the ends of a component 10 includes a male interconnective structure 24 and a female interconnective structure 26. The male structure 24 has a segmented head 24*a* which is compressible to fit through the female structure of an adjacent component, and then expandible to lock the components together. Of course, other interconnective structures are suitable for use with this invention.

Figure 5:
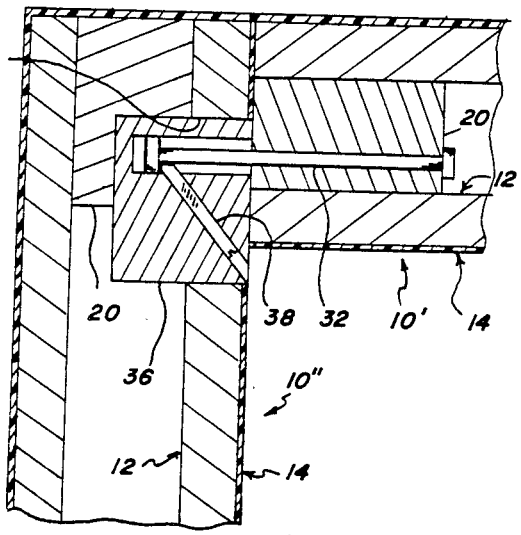
FIG. 5 is a top plan view, in cross-section, showing two components joined to form a corner of a structural frame.

FIG. 5 shows an arrangement where composite structural frame components 10' and 10'' are interconnected to form the corner 30 of a structural frame. The end of component 10' is constructed in a manner similar to that shown in FIG. 4, but with male interconnective structures 32 (one shown). The end of component 10'' is constructed in a manner similar to that shown in FIG. 3, but with a bores 34 (one shown) formed in the side wall thereof. Female interconnective structures 36 are seated within the bores 34 respectively. The particular female structure 36 shown is of the locking type in that it has a member 38 which is located in a first position which allows insertion of the male structure 32 into the female structure 36, and a second position which locks the male structure in the female structure. By this arrangement, the interconnective structures 32 are substantially hidden when the components 10' and 10'' are joined to form the corner 30. Thus, the corner has an appealing decorative appearance while forming a strong joint. Moreover, there is no interference from the interconnective structures with any items to be placed within the assembled frame.

The invention has been described in detail with particular reference to preferred embodiments thereof, but it will be understood that variations and modifications can be effected within the spirit and scope of the invention.

I claim:

1. An elongated composite structural frame component comprising:

an elongated substantially flat member having a plurality of V-shaped grooves, extending through the thickness thereof, and tapered marginal edges, said grooves and said edges being mutually parallel and parallel to the longitudinal axis of said flat member;

a relatively flexible member secured to said flat member to which the apexes of said grooves are directed, whereby when said flat member is folded along said grooves to form an elongated structure of substantially rectangular cross-section with a hollow interior, such structure is encased in said flexible member; and means for closing the ends of such elongated structure.

2. The invention of claim 1 wherein said flexible member has a decorative surface facing away from said flat member.

3. The invention of claim 2 wherein said end closing means includes an insert secured within the hollow interior of such structure adjacent to an end thereof, and a member secured to said insert having an outwardly directed decorative surface matching said decorative surface of said flexible member.

4. The invention of claim 2 wherein said end closing means includes an insert secured within the hollow interior of such structure adjacent to an end thereof, and interconnective means, supported by said insert, for facilitating the joining of two composite structural frame components.

5. The invention of claim 4 wherein said interconnective means comprises at least one male member extending outwardly from an insert, and a like number of female members seated within another insert.

6. The invention of claim 5 wherein said female members respectively include locking means for selectively retaining a male member within a female member.

7. A method for forming an elongated composite structural frame component from an elongated substantially flat member and a relatively flexible member, the method comprising the steps of:

securing the flexible member to the elongated flat member;

forming parallel V-shaped grooves in the flat member parallel to the longitudinal axis thereof, such grooves extending through the thickness of the flat member but not through the flexible member to form segments in the flat member;

folding the segments of the flat member along the grooves to establish an elongated structure having a substantially rectangular cross-section with a hollow interior;

securing the folded segments together, whereby the elongated structure is encased in the flexible member; and fixing members to the ends of the elongated structure to finish such ends.

8. The invention of claim 7 wherein the flexible member has a decorative surface and wherein, in the step of securing the flexible member to the flat member, the flexible member is oriented so that the decorative surface faces away from the flat member.

9. The invention of claim 7 further including the step of securing interconnective assemblies to the end members to enable two composite structural frame components to be joined.

* * * * *